United States Patent [19]

Zeis

[11] 4,172,244

[45] Oct. 23, 1979

[54] HIGH VOLTAGE RESISTANT SIGNAL TRANSMISSION DEVICE WITH ISOLATING TRANSFORMER

[75] Inventor: Jürgen Zeis, Berlin, Fed. Rep. of Germany

[73] Assignee: Licentia Patent-Verwaltungs-G.m.b.H., Fed. Rep. of Germany

[21] Appl. No.: 911,413

[22] Filed: Jun. 1, 1978

[30] Foreign Application Priority Data

Jun. 2, 1977 [DE] Fed. Rep. of Germany ..... 2724920

[51] Int. Cl.[2] ..... H01F 27/28; H01F 40/06

[52] U.S. Cl. ..... 336/73; 323/85; 336/171; 336/174; 361/1

[58] Field of Search ..... 323/6, 85; 361/1, 44, 361/45, 46; 333/17 L, 25; 336/73, 69, 170, 171, 173, 174, 175, 180, 181, 70

[56] References Cited

U.S. PATENT DOCUMENTS

| | | | |
|---|---|---|---|
| 1,808,670 | 6/1931 | Loubet | 336/174 X |
| 2,788,486 | 4/1957 | Guggi | 336/171 X |
| 2,994,028 | 7/1961 | Dortont | 336/175 X |

FOREIGN PATENT DOCUMENTS

| | | | |
|---|---|---|---|
| 411577 | 6/1934 | United Kingdom | 336/174 |

*Primary Examiner*—Thomas J. Kozma
*Attorney, Agent, or Firm*—McGlew and Tuttle

[57] ABSTRACT

The isolating transformer has two windings galvanically separated from each other and each connected to a respective point, which points are set at various high voltage potentials. At least one additional transformer is provided in series with the isolating transformer, and has two galvanically separated windings, with one winding being galvanically separated from the isolating transformer and the second winding being galvanically connected to a first winding of the isolating transformer. The second winding of the additional transformer is connected to one of the points and is split relative thereto in a manner such that a parasitic current produced between the two windings of the isolating transformer, and which is split with component currents flowing to both terminals of the first winding of the isolating transformer and therefrom to and into the split second winding of the additional transformer, produces, in the additional transformer, partial current flows which are mutually compensating to at least a great extent in their effect on the one winding of the additional transformer. Preferably two additional transformers are provided in series with the isolating transformer, each being operatively associated with a respective winding of the isolating transformer. One winding on one additional transformer is connected to the input and to ground, and one winding on the other additional transformer is connected to the output of the device. Each additional transformer may be a compensated transformer with one toroidal core, a compensated transformer with two toroidal cores, or a double compensated transformer with two toroidal cores.

4 Claims, 4 Drawing Figures

HIGH VOLTAGE RESISTANT SIGNAL TRANSMISSION DEVICE WITH ISOLATING TRANSFORMER

FIELD OF THE INVENTION

This invention relates to a high voltage resistant signal transmission device with an isolating transformer and, more particularly, to an improved such high voltage resistant signal transmission device with an isolating transformer.

BACKGROUND OF THE INVENTION

Signal transmission from a starting point to a receiver, having a substantially higher voltage potential, for example, occurs within a transmitter if there is a high-voltage between the control grid of a power tube and the starting point of the signal transmission. In this case, a point of separation, for example an isolating transformer between the starting point and the receiver, whose potentials have a high differential, must be provided in the transmission path to the control grid which, in this case, forms a receiver.

Difficulties occur with breakdowns in the isolating transformers, due to the fact that as a result intolerably high voltage are produced at its terminals. Furthermore, with other types of breakdown, voltages are coupled between the isolating transformer coils so that undesirable interference voltages are produced at its terminals.

Even if interfering voltages could be limited by means of semi-conductor-produced voltage peak limitations, there would still be a residual undesirably high interfering voltage.

SUMMARY OF THE INVENTION

The objective of the invention is to provide such a high voltage resistant signal transmission device, with an isolating transformer, in which the breakdown voltages are greatly reduced if not eliminated. In accordance with the invention, this problem is solved by providing an additional transformer in series with the isolating transformer, this additional transformer having two galvanically separated windings, with a first winding being galvanically separated from the isolating transformer and a second winding being galvanically connected to a first winding of the isolating transformer. The second winding of the additional transformer is connected to one of the points at various high voltage potentials, and is split relative thereto in a manner such that a parasitic current produced between the two windings of the isolating transformer, and which are split with component currents flowing to both terminals of a first winding of the isolating transformer and into the split second winding of the additional transformer, produces, in the additional transformer, partial current flows which are mutually compensating to at least a great extent in their effect on the first winding of the additional transformer.

An additional advantage of the invention improvement is that the effect of capacitive coupling between the coils of a transformer can be minimized.

Furthermore, two additional transformers, which are essentially identical in their construction and in their connection to the isolating transformer, can be provided, one in series with each respective winding of the isolation transformer.

An object of the invention is to provide an improved high voltage resistant signal transmission device with an isolating transformer.

Another object of the invention is to provide such an improved high voltage resistant signal transmission device in which the effects of breakdown voltages are greatly reduced.

A further object is to provide such an improved high voltage resistant signal transmission device in which there is an interference-free effect and in which no additional electrical components, for limiting interfering voltage peaking, are required, no additional capacitive loading of the transmission path input and output coils by protective circuitry is required, and no delayed responses through protective wiring are produced.

For an understanding of the principles of the invention, reference is made to the following description of typical embodiments thereof as illustrated in the accompanying drawings.

DESCRIPTION OF THE PREFERRED EMBODIMENTS

Figure 1:
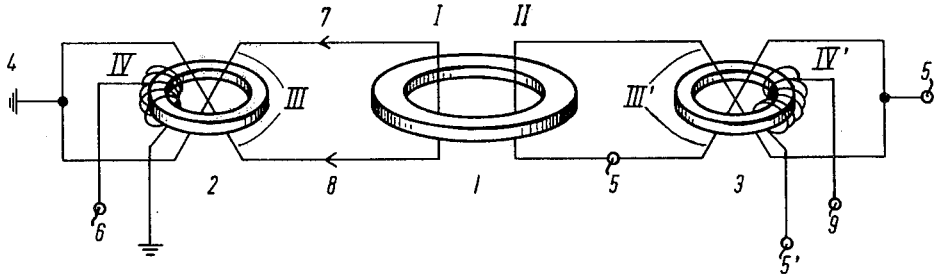
FIGS. 1, 2 and 3 are schematic wiring diagrams of different exemplified embodiments of the invention.
Figure 2:
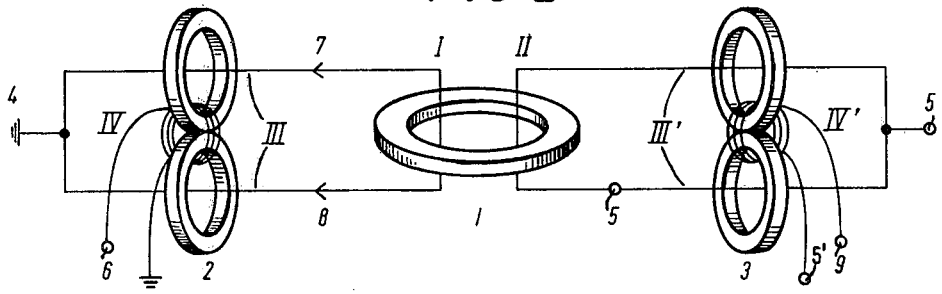
Figure 3:
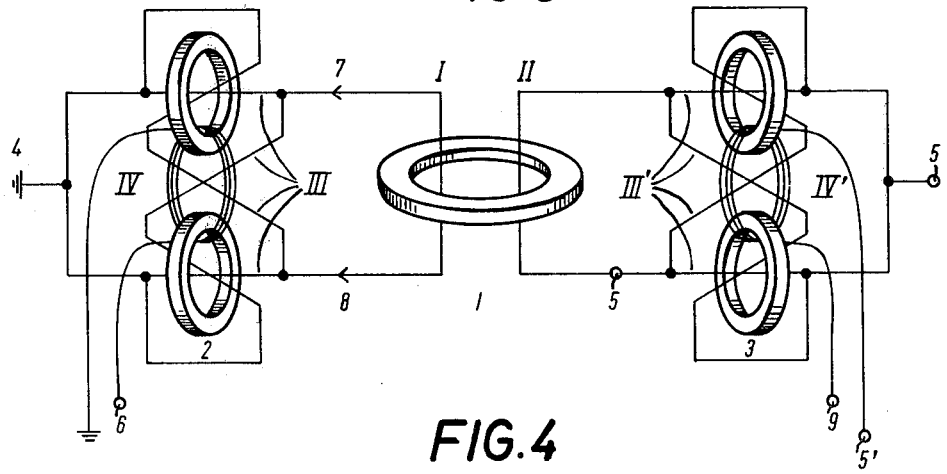

Referring to FIGS. 1, 2 and 3, each of the illustrated circuits has, at its center, an isolating transformer 1 with two windings I and II. Considered in the direction from the input to the output of each circuit, isolating transformer 1 is preceded by an additional transformer 2, in series with isolating transformer 1, and having an input winding IV connected to the input terminals 6 of the transmission path. The other or second winding III of transformer 2 is a split type winding, which is galvanically connected to winding I of isolating transformer I. Winding III of transformer 2 is also connected to a point 4, at ground potential, as contrasted with point 5 of winding II of isolating transformer 1 to which there is applied a high voltage potential. Thus, points 4 and 5 are at various high voltage potentials relative to each other.

The connection of winding III to grounded point 4, and the split-up of winding III, is such that an interference current, appearing between the windings I and II of isolating transformer 1, and produced, for example, by an assumed breakdown between windings I and II, and which interference current flows in the direction of the arrow to point 4 through lines 7 and 8, produces, because of its splitting up into two component currents, two partial flows in additional transformer 2, and which are mutually compensated to at least a great extent in their effect on the separate winding IV of transformer 2. Consequently, such an interference current produces no magnetic flux in the magnetic core of additional transformer 2 and, as a result, no voltage across winding IV and input terminal 6.

The same considerations apply to the right hand sides of FIGS. 1, 2 and 3 as apply to the left hand sides thereof, with the additional transformer 3 having a split winding III' and an output winding IV' connected to output terminals 5' and 9.

Using the circuit arrangement shown in FIGS. 1, 2 and 3, it is possible, for example, to transmit carrier frequency oscillations from the starting point potential applied to input terminal 6 to the receiver connected to the output terminals 5' and 9 and to which output terminals another potential is applied. In case of interference, the voltage between the transmission path input and its output, for example, can amount for a short time to 60 kV, while the standard direct voltage value is about 12 kV. Even with such a short time high potential, in an assumed case of breakdown, the carrier frequency voltage source at input terminals 6 will not be affected by the breakdown. This is accomplished so that the additional transformer 2 galvanically separates the carrier frequency source from the ground potentials of windings I and III, and the point 4. The receiver either can be connected directly to winding II, by omitting the further transformer 3, whereby the isolating transformer 1 alone performs a potential isolation, or the receiver can be connected to terminals 9 and 5', whereby the potential isolation is effected solely by an isolating transformer 1 if terminals 5 and 5' are interconnected while otherwise, namely if terminal 5 and 5' are set at different potentials, the potential isolation is split up between isolating transformer 1 and further transformer 3.

Figure 4:
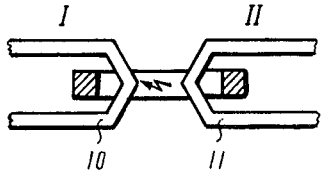
FIG. 4 is an elevation view, partly in section, of a design detail of the isolating transformer.

Inasmuch as the interference-free effect of the device according to the invention is optimized if it is assured that any assumed breakdowns between windings I and II occur at their center, these single-turn windings are, in practice, developed as illustrated in FIG. 4, so that windings 10 and 11 have their interspacing minimized at the center between their associated terminals. As a result, where the minimal spacing is present and where, in the drawings, the symbol of a bolt of lightning is entered, a preponderance of the breakdowns occurs.

By means of the symmetrical winding design, an additional advantage is produced whereby capacitive reactive currents become symmetrical, which results in a boost in the operational breakdown safety. Furthermore, the effect of capacitive coupling between the input winding IV and the output winding IV' is reduced. Finally, with the device according to the invention, no additional electrical components, for limiting breakdown voltage peaking, are required. Also, no additional capacitive loading of transmission path input and output windings, by protective circuitry, is required. Further, no delayed responses through protective wiring are produced.

Additional transformer 2, in the embodiment of FIG. 1, is designed as a compensated transformer with one toroidal core. In FIG. 2, an additional transformer 2 is designed as a compensated transformer with two toroidal cores and, in FIG. 3, it is designed as a double-compensated transformer. It has been proven, in practice, that with these three possibilities not only is there a great difference in design input but also in the freedom from interference, depending on whether the influx of interference current in FIG. 4 occurs in the horizontal symmetry line, that is, where the distance between windings 10 and 11 is a minimum, or more or less above or below the symmetrical line. The selection of one of the three possibilities, or any other possibility in accordance with the invention principles, is a function of design input desired, and of the desired degree of freedom from interference as well as of the type of interference influx.

While specific embodiments of the invention have been shown and described in detail to illustrate the application of the principles of the invention, it will be understood that the invention may be embodied otherwise without departing from such principles.

What is claimed is:

1. In a high voltage resistant signal transmission device, with a high voltage resistant isolating transformer having two windings galvanically separated from each other and each connected to a respective point, which points are set at various high voltage potential differences: the improvement comprising, in combination, an additional transformer in series with said isolating transformer; said additional transformer having two galvanically separated windings, with a first winding being galvanically separated from said isolating transformer and a second winding being galvanically connected to a first winding of said isolating transformer; said second winding of said additional transformer being connected to one of said points and split relative thereto in a manner such that a parasitic current produced between the two windings of said isolating transformer, and which is split with component currents flowing to both terminals of said first winding of said isolating transformer and therefrom to and into said split second winding of said additional transformer, produces, in said additional transformer, partial current flows which are mutually compensating to at least a great extent in their effect on said first winding of said additional transformer.

2. In a high voltage resistant signal transmission device, the improvement claimed in claim 1, in which the windings of said isolating transformer have their minimum interspacing located at the center between their associated terminals.

3. In a high voltage resistant signal transmission device, the improvement claimed in claim 1, a further transformer identical with said additional transformer and having two galvanically separated windings, with one winding being galvanically separated from said isolating transformer and the other winding being galvanically connected to the second winding of said isolating transformer; said second winding of said further transformer being connected to the other of said points and split relative thereto in a manner such that a parasitic current produced between the two windings of said isolating transformer, and which is split with component currents flowing to both terminals of the other winding of said isolating transformer and therefrom to and into the split second winding of said further transformer, produces, in said further transformer, partial current flows which are mutually compensating to at least a great extent in their effect on said first winding of said further transformer.

4. In a high voltage resistant signal transmission device, the improvement claimed in claim 3, in which the windings of said isolating transformer have their minimum interspacing located at the center between their associated terminals.

* * * * *